US009488036B2

(12) United States Patent
Ross et al.

(10) Patent No.: US 9,488,036 B2
(45) Date of Patent: Nov. 8, 2016

(54) DRILLING SHAFT ABUTTING APPARATUS

(71) Applicants: Damon Barry Ross, Sherwood Park (CA); Darcy Tupechka, Cochrane (CA)

(72) Inventors: Damon Barry Ross, Sherwood Park (CA); Darcy Tupechka, Cochrane (CA)

(73) Assignee: Total Coverage Services Ltd., Sherwood Park (CA)

( * ) Notice: Subject to any disclaimer, the term of this patent is extended or adjusted under 35 U.S.C. 154(b) by 202 days.

(21) Appl. No.: 14/274,570

(22) Filed: May 9, 2014

(65) Prior Publication Data

US 2015/0240603 A1 Aug. 27, 2015

Related U.S. Application Data

(60) Provisional application No. 61/943,355, filed on Feb. 22, 2014.

(51) Int. Cl.
*E21B 41/00* (2006.01)
*E21B 17/00* (2006.01)

(52) U.S. Cl.
CPC ..... *E21B 41/0021* (2013.01); *E21B 17/006* (2013.01)

(58) Field of Classification Search
CPC ..... E21B 33/063; E21B 41/0021; E21B 17/006; E21B 29/08; E21B 29/007; E21B 31/16; E21B 31/18; E21B 33/06
See application file for complete search history.

(56) References Cited

U.S. PATENT DOCUMENTS 1,599,067 A * 9/1926 Segelhorst ..... E21B 31/18 166/55.6
1,625,391 A * 4/1927 Reilly ..... E21B 29/007 166/55.6
1,709,141 A * 4/1929 McCullough ..... E21B 29/007 166/55.6
1,834,071 A * 12/1931 Reed ..... E21B 29/007 166/55.6
2,179,191 A 11/1939 Mcwilliams
2,532,341 A 12/1950 Shannon
3,298,450 A * 1/1967 Sato ..... E02D 1/04 175/226
4,747,453 A 5/1988 Howard
4,919,989 A 4/1990 Colangelo
5,845,442 A 12/1998 Strehlow
6,453,603 B1 9/2002 Baker
6,488,440 B1 12/2002 Hill
6,584,734 B2 7/2003 Mihalicz et al.
7,143,832 B2 12/2006 Freyer
7,692,140 B1 4/2010 Hall et al.
8,127,859 B2 3/2012 Allison et al.

(Continued)

FOREIGN PATENT DOCUMENTS

CA 1248364 1/1989
CA 2434840 7/2002

(Continued)

*Primary Examiner* — Shane Bomar
(74) *Attorney, Agent, or Firm* — Richard D. Okimaw

(57) ABSTRACT

A drilling shaft abutting apparatus is disclosed herein. The apparatus includes a plate having an arcuate edge. The arcuate edge is configured to at least partially encircle a drilling shaft. The apparatus also includes a first blade mounted on the plate for pivoting movement between a first retracted position and a first fully-pivoted position. The first blade passes across the arcuate edge during movement between the first retracted position and the first fully-pivoted position. The first blade prevents items from falling down a hole at least partially occupied by the drilling shaft. The apparatus includes at least one actuator operable to selectively urge the first blade to at least one of the first retracted position and the first fully-pivoted position.

12 Claims, 4 Drawing Sheets

(56) References Cited

U.S. PATENT DOCUMENTS

| | | | | |
|---|---|---|---|---|
| 2013/0111988 | A1 | 5/2013 | Newton | |
| 2014/0014361 | A1* | 1/2014 | Nelson | E21B 33/06 166/373 |
| 2014/0041501 | A1* | 2/2014 | Allensworth | E21B 29/04 83/564 |

FOREIGN PATENT DOCUMENTS

| | | |
|---|---|---|
| CA | 2250483 | 10/2006 |
| CA | 2701560 | 4/2009 |

* cited by examiner

DRILLING SHAFT ABUTTING APPARATUS

CROSS REFERENCE TO RELATED APPLICATION

This application claims priority from U.S. Provisional Patent Application No. 61/943,355 filed Feb. 22, 2014 entitled Drilling Shaft Abutting Apparatus.

BACKGROUND OF THE INVENTION

1. Field of Invention

The invention relates to Earth drilling and more particularly to structures associated with preventing items from falling down a hole at least partially occupied by the drilling shaft.

2. Description of Related Art

U.S. Pat. No. 6,584,734 disclosed a LOCKING GROUND HOLE COVER.

The locking ground hole cover that is disclosed comprises a cover plate with a scissor-type apparatus suspended therefrom which apparatus can be actuated from above the cover plate. The apparatus allows for the locking of a hole by pulling the cover plate down into a sealed locked position with the hole mouth. Variations on the device are disclosed in the '734 patent.

SUMMARY OF THE INVENTION

In summary, the invention is a drilling shaft abutting apparatus. The apparatus includes a plate having an arcuate edge. The arcuate edge is configured to at least partially encircle a drilling shaft. The apparatus also includes a first blade mounted on the plate for pivoting movement between a first retracted position and a first fully-pivoted position. The first blade passes across the arcuate edge during movement between the first retracted position and the first fully-pivoted position. The first blade prevents items from falling down a hole at least partially occupied by the drilling shaft. The apparatus includes at least one actuator operable to selectively urge the first blade to at least one of the first retracted position and the first fully-pivoted position.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
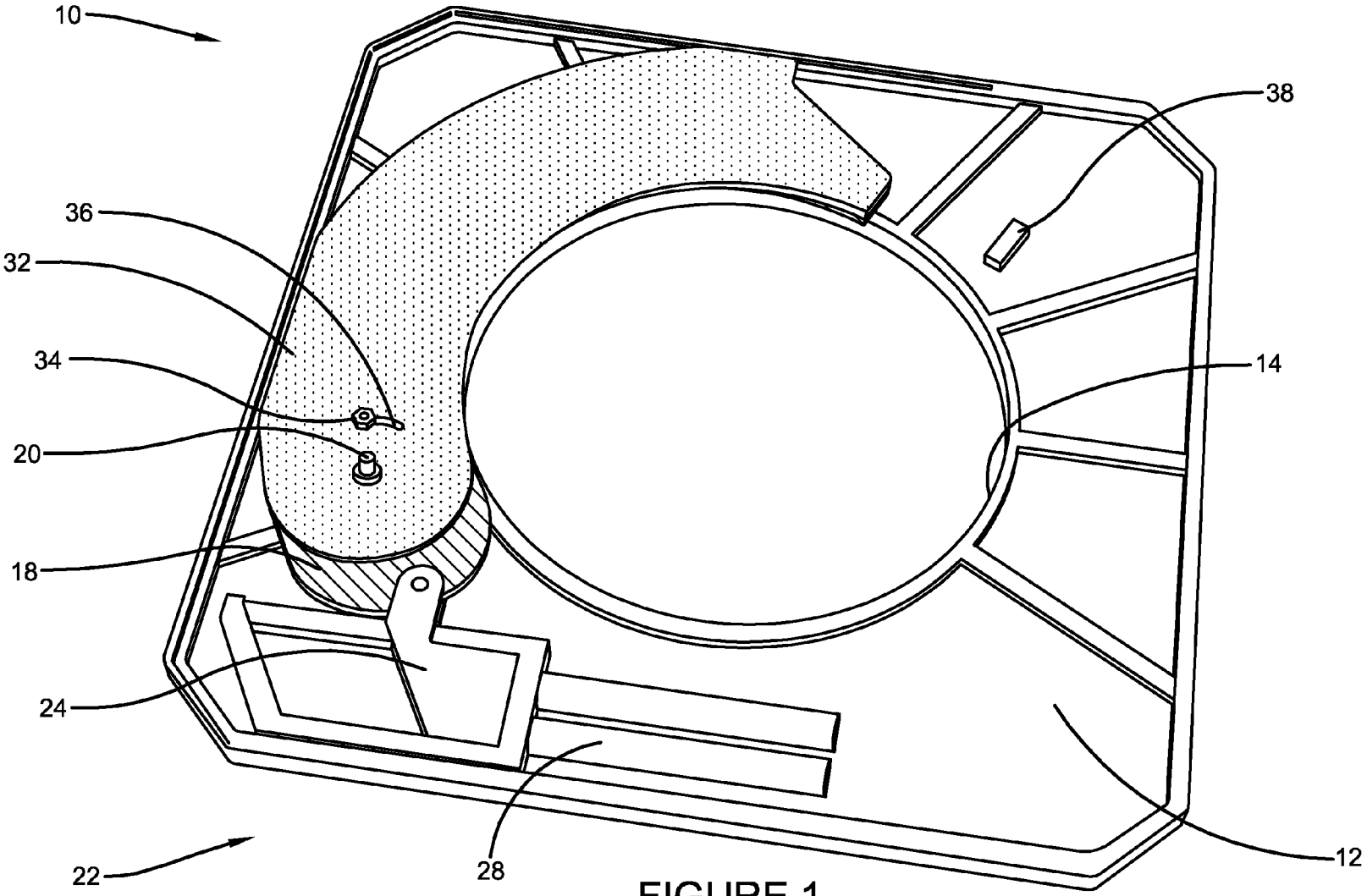
FIG. 1 is a perspective view of a drilling shaft abutting apparatus according to an exemplary embodiment of the invention with a first blade in a retracted position.

In this disclosure, similar features have been numbered with a common reference numeral and have been differentiated by an alphabetic suffix.

Similar features are structured similarly, operate similarly, and/or have the same function unless otherwise indicated by the drawings or this specification.

The invention, as demonstrated by the exemplary embodiment described below, can provide a solution to prevent articles from falling down a hole created by a drilling arrangement, such as through the gap surrounding a drilling shaft. One or more embodiments of the broader invention can selectively close the gap and need not be removed even after the drilling shaft is removed. Also, one or more embodiments of the broader invention can be universal, accommodating drilling shafts of various sizes.

FIG. 1 is a perspective view of a drilling shaft abutting apparatus 10. The apparatus 10 includes a plate 12 having an arcuate edge 14. The arcuate edge 14 is configured to at least partially encircle a drilling shaft (referenced at 16 in FIGS. 4 and 5). In the exemplary embodiment, the arcuate edge 14 is an aperture, a continuous surface encircling a volume. In other embodiments, arcuate edge can be less than an aperture.

Figure 2:
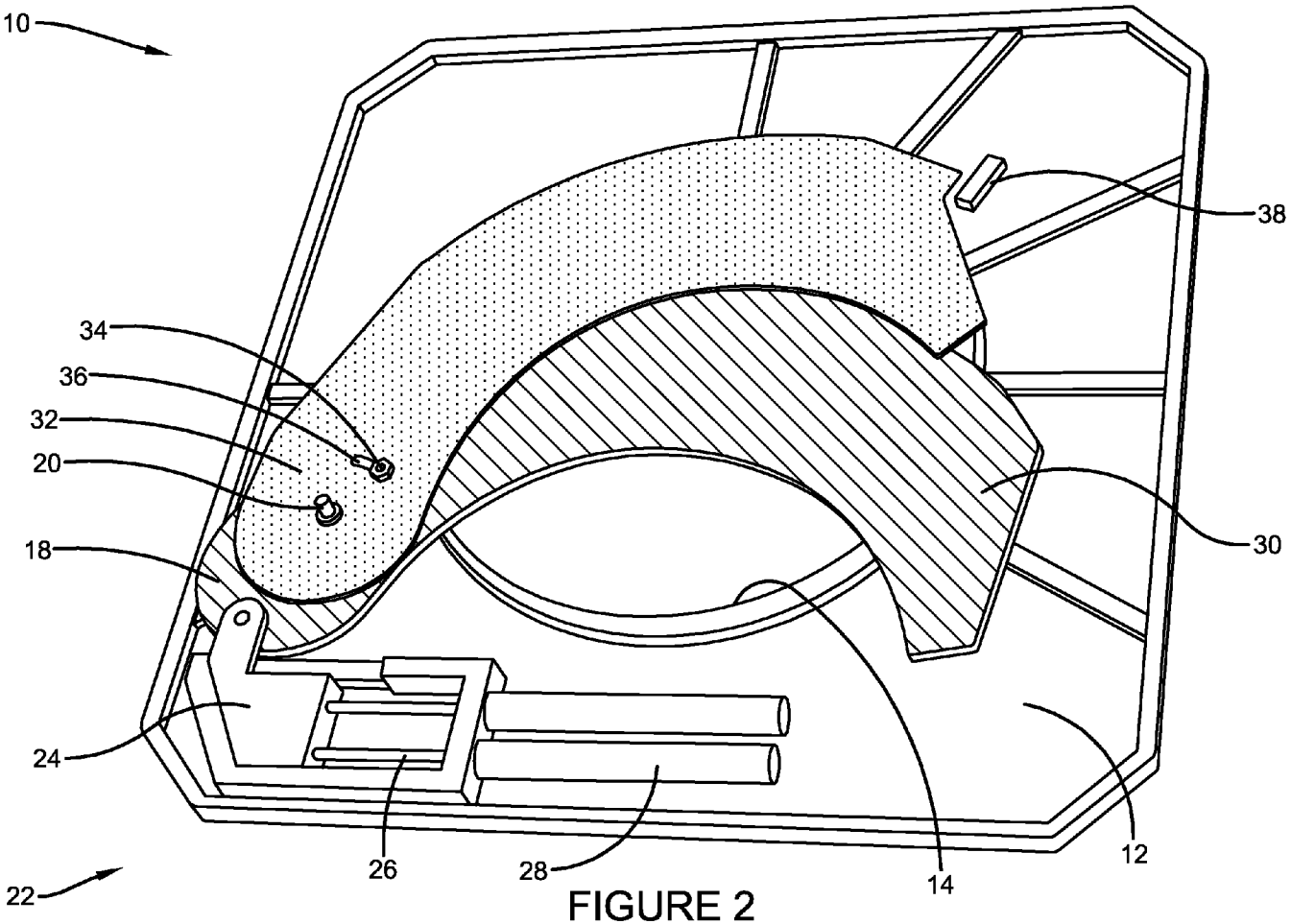
FIG. 2 is a perspective view of a drilling shaft abutting apparatus according to an exemplary embodiment of the invention with a first blade in a fully-pivoted position.

The apparatus also includes a first blade 18 mounted on the plate 12 for pivoting movement between a first retracted position and a first fully-pivoted position. In the exemplary embodiment, the first blade 18 pivots about a pivot axis 20. In FIG. 1, the first blade 18 is shown in the retracted position. In FIG. 2, the first blade 18 is shown in the fully-pivoted position. The first blade 18 passes across the arcuate edge 14 during movement between the first retracted position and the first fully-pivoted position. The first blade 18 prevents items from falling down a hole at least partially occupied by the drilling shaft 16.

The apparatus 10 includes at least one actuator 22 operable to selectively urge the first blade 18 to at least one of the first retracted position and the first fully-pivoted position. The actuator 22 can be electric, pneumatic, hydraulic, or apply any other approach to urging movement. In the exemplary embodiment, the actuator 22 is a cylindrical and is disposed to urge the first blade 18 to the first fully-pivoted position from the retracted position. The actuator 22 includes a working end 24 rotatably mounted the first blade 18. The working end 24 can be moved by one or more extendable rods 26 from the actuator 22. The apparatus 10 can also include a biasing spring disposed to urge the first blade 18 away from the first fully-pivoted position and toward the first retracted position. In the exemplary embodiment, the biasing spring can be disposed internal of one or more cylinders 28 of the actuator 22. In other embodiments, the biasing spring can be external of the cylinders 28. It is also noted that in one or more alternative embodiment of the broader invention, the biasing spring can be arranged to move the blades into the fully-pivoted position, like a default.

The first blade 18 can be arranged such that it crosses over a center of the aperture 14 when in the fully-pivoted position. This is shown in FIG. 2. This increases the likelihood that the first blade 18 will contact the drilling shaft 16 since the drilling shaft 16 could be positioned in an infinite number of positions with the aperture 14. Further, even if the first blade 18 does not contact the drilling shaft 16, the movement of the first blade 18 over the center of the aperture 14 enhances the area of coverage over the aperture 14 that the first blade 18 can provide.

In the exemplary embodiment, the first blade 18 can be arranged such that at least a portion of a distal end 30 of the first blade 18 is disposed above a portion of the plate 12 throughout movement between the first retracted position and the first fully-pivoted position. This feature allows the first blade 18 to be supported against failure or plastic deformation if an object falls on the first blade 18.

The specific, exemplary embodiment of the broader invention includes a second blade 32 mounted on the plate 12 for pivoting movement between a second retracted position and a second fully-pivoted position. In FIG. 1, the second blade 32 is shown in the retracted position and overlapping the first blade 18. In FIG. 2, the second blade 32 is shown in the fully-pivoted position. Like the first blade 18, the second blade 32 can at least partially pass across the arcuate edge 14 during movement between the first retracted position and the first fully-pivoted position. The second blade 32 can prevent items from falling down a hole at least partially occupied by the drilling shaft 16.

In the exemplary embodiment, the second blade 32 and the first blade 18 can pivot about a common pivot axis, the pivot axis 20. The second blade 32 and the first blade 18 can be engaged with one another such that the second blade 32 at least partially follows the first blade 18 in motion. A cam or driver 34 can project from the first blade 32 and into a slot 36 fixed to the second blade 32. As the first blade 18 and driver 34 move, the driver 34 can urge the second blade 32 in motion through the slot 36.

In one or more embodiments of the broader invention, the second blade 32 can at least partially follow the first blade 18 in that the movement of the first blade 18 causes, at least partially, movement of the second blade 32. The second blade 32 and the first blade 18 are engaged for at least one range of concurrent motion and for at least one range of lost motion in which only one of the first and second blades 18, 32 is moving. FIG. 1 shows that the first and second blades 18, 32, similar shaped in the exemplary embodiment, overlap precisely when in the retracted position. FIG. 2 shows that the first and second blades 18, 32 do not overlap precisely when in the fully-pivoted position.

During movement from the retracted position to the fully-pivoted position, a first range motion occurs when the first blade 18 moves from the retracted position to an intermediate position, the intermediate position is spaced from both of the retracted position and the fully-pivoted position. During this first range of motion, the driver 34 moves freely with the slot 36. When the first blade 18 reaches the intermediate position, driver 34 contacts a first closed end of the slot 36 and a second range of motion commences. During the second range of motion, the first and second blades 18, 32 both pivot about the pivot axis 20 toward their respective fully-pivoted positions.

During movement from the fully-pivoted position to the retracted position, a first range motion occurs when the first blade 18 moves from the fully-pivoted position to an intermediate position, the intermediate position is spaced from both of the retracted position and the fully-pivoted position. During this first range of motion, the driver 34 moves freely with the slot 36. When the first blade 18 reaches the intermediate position, driver 34 contacts a second closed end of the slot 36 (opposite to the first closed end) and a second range of motion commences. During the second range of motion, the first and second blades 18, 32 both pivot about the pivot axis 20 toward their respective retracted positions.

In the exemplary embodiment, one or more protuberance 38 project from the plate 12. The protuberance 38 defines a positive stop against motion of at least of one of the first blade 18 and the second blade 32. In the exemplary embodiment, the protuberance 38 is disposed along a path of movement of the second blade 32 and spaced from a path of movement of the first blade 18. The protuberance 38 can thus stop movement of the second blade 32 and, through the interaction of the driver 34 and the slot 36, can also stop movement of the first blade 18.

Figure 3:
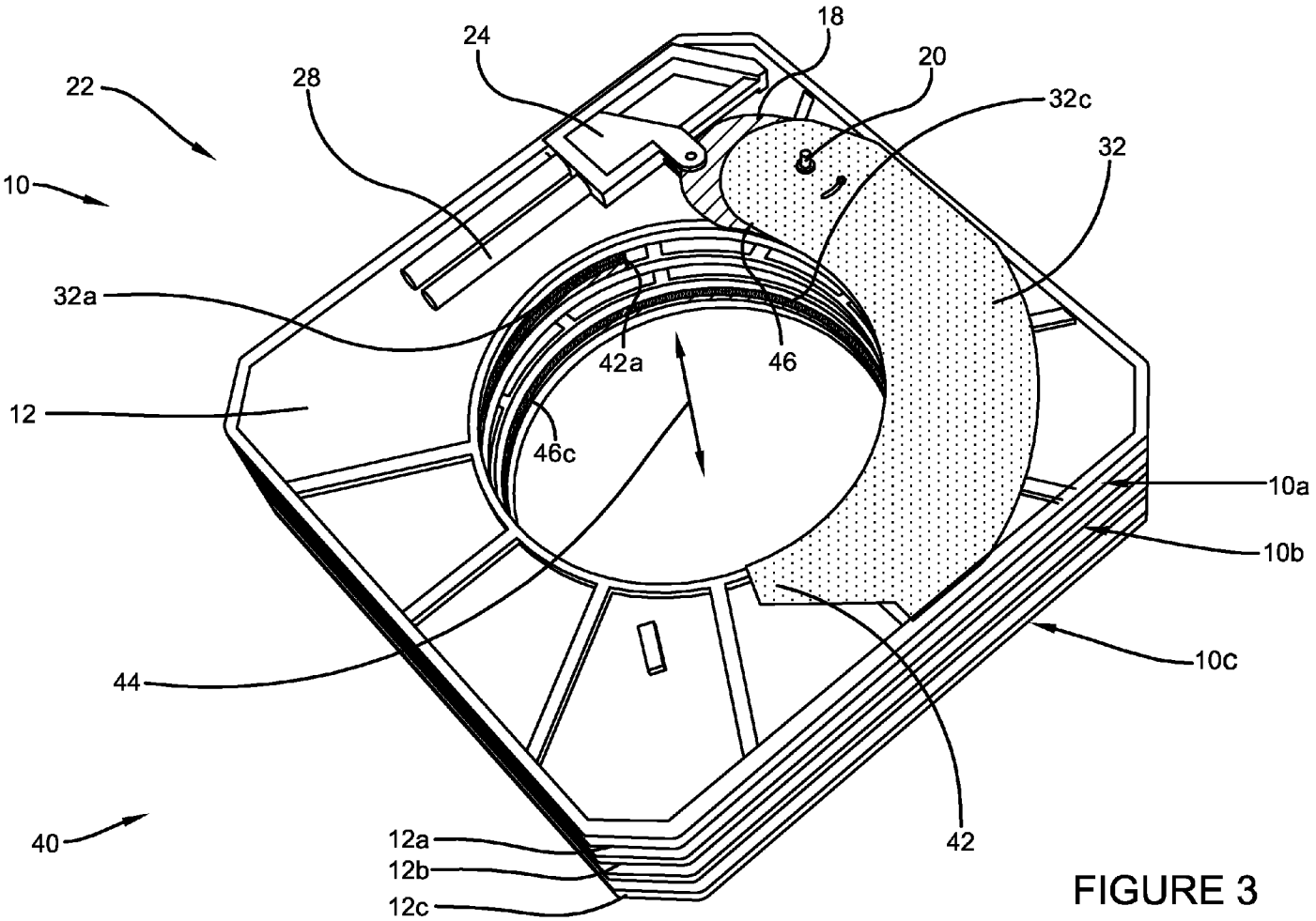
FIG. 3 is a perspective view of a drilling shaft abutting assembly including a plurality of drilling shaft abutting apparatus according to an exemplary embodiment of the invention with first blades of each drilling shaft abutting apparatus in respective retracted positions.

FIG. 3 is a perspective view of a drilling shaft abutting assembly 40. The assembly 40 includes a plurality of drilling shaft abutting apparatus 10, 10*a*, 10*b*, 10*c*. FIG. 3 shows the respective first blades of each apparatus 10, 10*a*, 10*b*, 10*c* in respective retracted positions. The apparatus 10, 10*a*, 10*b*, 10*c* are stacked on top of one another. Stacking does not requiring physical contact between the respective plates 12, 12*a*, 12*b*, 12*c* or other components of the apparatus 10, 10*a*, 10*b*, 10*c*. The respective arcuate edges of the plates 12, 12*a*, 12*b*, 12*c* are aligned in the exemplary embodiment.

FIG. 3 also shows that the apparatus 10, 10*a*, 10*b*, 10*c* are rotated with respect to one another. For example, a distal end 42 of the second blade 32 is spaced about one hundred and eighty (180) degrees from a distal end 42*a* of the second blade 32*a* about a central axis 44 of the aligned arcuate edges. The blades 32, 32*a* are components of apparatus 10, 10*a* which are vertically adjacent to one another along the axis 44. FIG. 3 also shows that a base end 46 of the second blade 32 is spaced about ninety (90) degrees from a base end 46*c* of the second blade 32*c* about the central axis 44. The blades 32, 32*c* are components of apparatus 10, 10*c* which are vertically spaced from one another along the axis 44, the apparatus 10*a*, 10*b* disposed between the apparatus 10, 10*c*. The actuators (not visible) controlling the first blades 18, 18*a*, 18*b*, 18*c* can be controlled independently of one another.

Thus, the apparatus 10, 10*a*, 10*b*, 10*c* can be arranged in pairs, where each apparatus of a pair is rotated with respect to one another and where pairs are rotated with respect to each other. In the exemplary embodiment, a first and second apparatus 10, 10*a* define a first pair and are adjacent to one another along the axis 44. The first and second apparatus 10, 10*a* are rotated about one hundred and eighty (180) degrees with respect to one another. Third and fourth apparatus 10*b*, 10*c* define a second pair and are adjacent to one another along the axis 44. The third and fourth apparatus 10*b*, 10*c* are rotated about one hundred and eighty (180) degrees with respect to one another. The first and second pairs are rotated about ninety (90) degrees with respect to one another about the axis 44.

Figure 4:
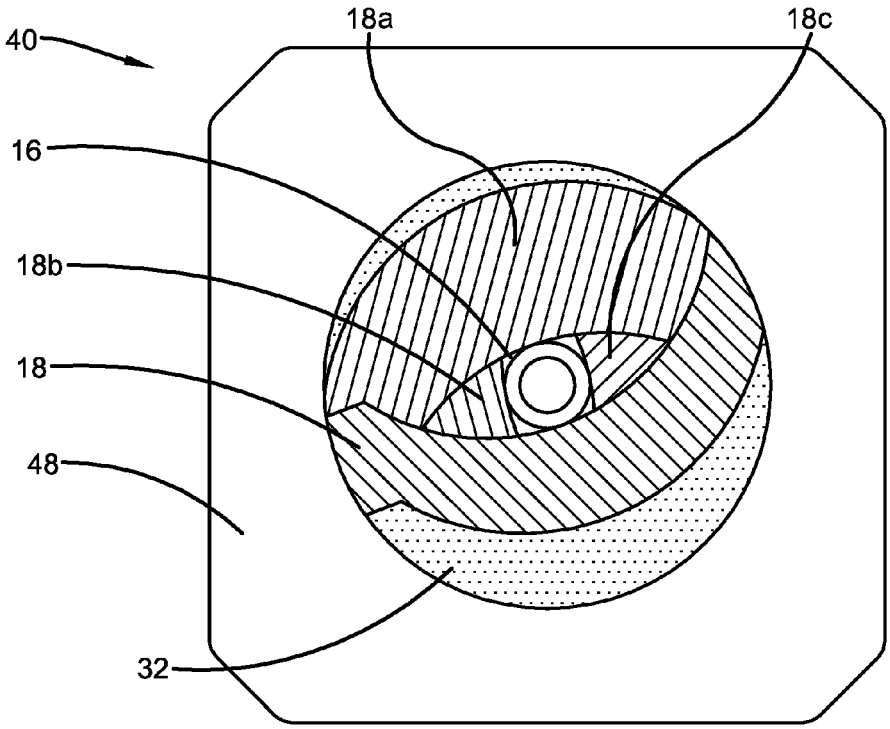
FIG. 4 is a top view of a drilling shaft abutting assembly including a plurality of drilling shaft abutting apparatus according to an exemplary embodiment of the invention with first blades of each drilling shaft abutting apparatus in respective pivoted positions and closing a gap around a drilling shaft that is centered.

In the assembly 40, the respective first blades can be selectively urged to different positions between the respective first retracted positions and the first fully-pivoted positions. This allows the gap surrounding the drilling shaft 16 to be minimized. FIG. 4 is a top view of a drilling shaft abutting assembly 40 including a plurality of drilling shaft abutting apparatus according to an exemplary embodiment of the invention. A cover 48 has been added to the assembly 40. The first blades 18, 18*a*, 18*b*, 18*c* are pivoted to respective positions to close as much of the gap around the drilling shaft 16 as possible.

Each of the first blades 18, 18*a*, 18*b*, 18*c* may be displaced or pivoted until that blade contacts the drilling shaft 16 or until abutting a protuberance as discussed above. In FIG. 4, the drilling shaft 16 is centered and so the first blades 18, 18*a*, 18*b*, 18*c* may be displaced or pivoted an equal amount until all contact the drilling shaft 16.

Figure 5:
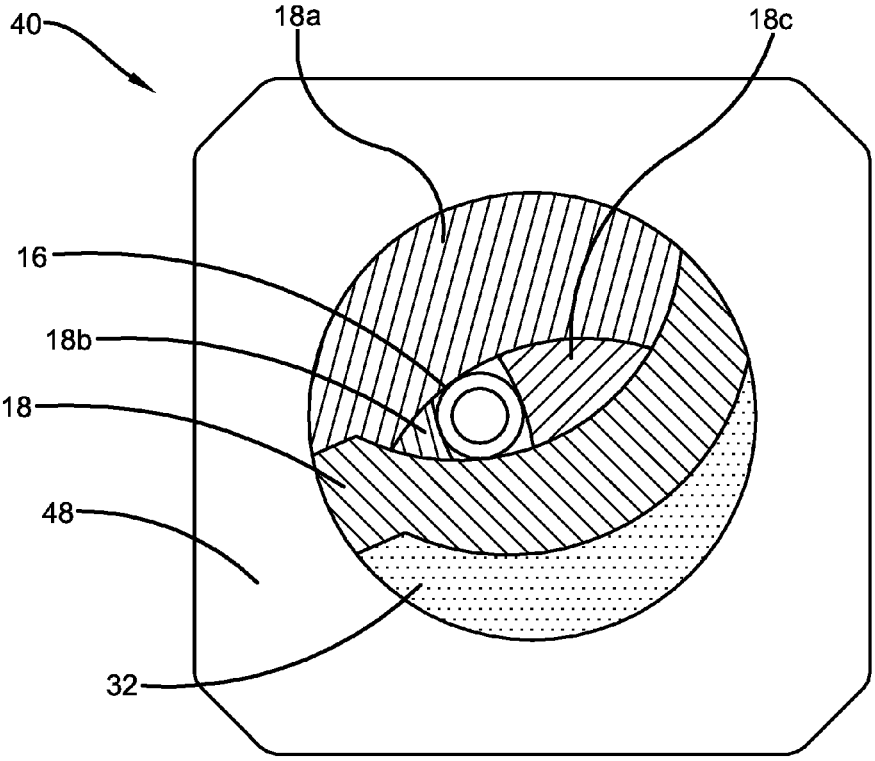
FIG. 5 is a top view of a drilling shaft abutting assembly including a plurality of drilling shaft abutting apparatus according to an exemplary embodiment of the invention with first blades of each drilling shaft abutting apparatus in respective pivoted positions and closing a gap around a drilling shaft that is off-center.

FIG. 5 is a top view of the drilling shaft abutting assembly 40, with the drilling shaft 16 off-center. The first blades 18, 18*a*, 18*b*, 18*c* are pivoted to respective positions to close as much of the gap around the drilling shaft 16 as possible. The drilling shaft 16 is not centered and so the first blades 18, 18*a*, 18*b*, 18*c* may be displaced or pivoted unequal amounts. One or more the first blades 18, 18*a*, 18*b*, 18*c* can be pivoted until contacting the drilling shaft 16 while other first blades 18, 18*a*, 18*b*, 18*c* can be pivoted until contacting a protuberance. It is noted that when a drilling shaft does not extend through the assembly 40, all of the first blades 18, 18*a*, 18*b*, 18*c* (as well as any second blades) can be disposed in the fully-pivoted position, thus fully closing the hole.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Further, the "invention" as that term is used in this document is what is claimed in the claims of this document. The right to claim elements and/or sub-combinations that are disclosed herein as other inventions in other patent documents is hereby unconditionally reserved.

While specific embodiments of the invention have been described and illustrated, such embodiments should be considered illustrative of the invention only and not as limiting the invention as construed in accordance with the accompanying claims.

What is claimed is:

1. A drilling shaft abutting apparatus comprising:

a plate having an arcuate edge, said arcuate edge configured to at least partially encircle a drilling shaft;

a first blade mounted on said plate for pivoting movement between a first retracted position and a first fully-pivoted position wherein said first blade passes across said arcuate edge during movement between said first retracted position and said first fully-pivoted position and wherein said first blade prevents items from falling down a hole at least partially occupied by the drilling shaft;

at least one actuator operable to selectively urge said first blade to at least one of said first retracted position and said first fully-pivoted position; and a second blade mounted on said plate for pivoting movement between a second retracted position and a second fully-pivoted position wherein said second blade and said first blade are engaged for at least one range of concurrent motion and for at least one range of lost motion in which only one of said first and second blades is moving.

2. The drilling shaft abutting apparatus of claim 1 wherein said arcuate edge is further defined as an aperture.

3. The drilling shaft abutting apparatus of claim 2 wherein said first blade crosses over a center of said aperture when in said fully-pivoted position.

4. The drilling shaft abutting apparatus of claim 1 wherein at least a portion of a distal end of said first blade is disposed above a portion of said plate throughout movement between said first retracted position and said first fully-pivoted position.

5. The drilling shaft abutting apparatus of claim 1 wherein said second blade and said first blade pivot about a common pivot axis.

6. The drilling shaft abutting apparatus of claim 1 further comprising a protuberance projecting from said plate and defining a positive stop against motion of at least of one of said first blade and said second blade.

7. The drilling shaft abutting apparatus of claim 1 wherein a protuberance is disposed along a path of movement of said second blade and spaced from a path of movement of said first blade.

8. The drilling shaft abutting apparatus of claim 1 wherein said actuator is further defined as being disposed to urge the first blade to the first fully-pivoted position.

9. The drilling shaft abutting apparatus of claim 8 further comprising:

a biasing spring disposed to urge the first blade one of:

away from the first fully-pivoted position and toward the first retracted position; and away from the first retracted position and toward the first fully-pivoted position.

10. A method for preventing items from falling down a hole at least partially occupied by a drilling shaft comprising the steps of:

at least partially encircling a drilling shaft with an arcuate edge of a plate;

mounting a first blade on the plate for pivoting movement between a first retracted position and a first fully-pivoted position wherein the first blade passes across the arcuate edge during movement between the first retracted position and the first fully-pivoted position and wherein the first blade prevents items from falling down the hole at least partially occupied by the drilling shaft;

stacking a plurality of plates, each having a respective first blade and each at least partially encircling the drilling shaft, on top of one another; and selectively urging the first blade to at least one of the first retracted position and the first fully-pivoted position, wherein said selectively urging step is defined as selectively urging at least two of the first blades to different positions between the first retracted position and the first fully-pivoted position.

11. The method of claim 10 further comprising the steps of:

withdrawing the drilling shaft from proximity to said plurality of plates; and substantially fully closing the hole with the first blades.

12. A drilling shaft encircling assembly comprising:

a plurality of drilling shaft abutting apparatus according to claim 1, wherein said plurality of drilling shaft abutting apparatus are stacked on top of one another and rotated with respect to one another.

* * * * *